US012089646B2

(12) United States Patent
Batista et al.

(10) Patent No.: US 12,089,646 B2
(45) Date of Patent: Sep. 17, 2024

(54) SYSTEM FOR GENERATING AN AEROSOL

(71) Applicant: Philip Morris Products S.A., Neuchatel (CH)

(72) Inventors: Rui Nuno Batista, Neuchatel (CH); Frederic Nicolas, Nantes (FR); Cyrille Poindron, Onex (CH)

(73) Assignee: Philip Morris Products S.A., Neuchatel (CH)

( * ) Notice: Subject to any disclaimer, the term of this patent is extended or adjusted under 35 U.S.C. 154(b) by 809 days.

(21) Appl. No.: 17/262,014

(22) PCT Filed: Jul. 24, 2019

(86) PCT No.: PCT/EP2019/069930

§ 371 (c)(1),
(2) Date: Jan. 21, 2021

(87) PCT Pub. No.: WO2020/020951

PCT Pub. Date: Jan. 30, 2020

(65) Prior Publication Data

US 2021/0307399 A1 Oct. 7, 2021

(30) Foreign Application Priority Data

Jul. 26, 2018 (EP) ..... 18185903

(51) Int. Cl.
*A24F 40/465* (2020.01)
*A24F 40/51* (2020.01)
(Continued)

(52) U.S. Cl.
CPC ..... *A24F 40/465* (2020.01); *A24F 40/51* (2020.01); *A24F 40/53* (2020.01); *A24F 40/57* (2020.01)

(58) Field of Classification Search
CPC ..... A24F 40/465; A24F 40/51; A24F 40/53; A24F 40/57; A24F 40/20; A24F 40/42; A24F 47/00; H05B 6/1245
(Continued)

(56) References Cited

U.S. PATENT DOCUMENTS 7,070,743 B2 * 7/2006 Blackwell ..... B01J 35/04 422/186.01
10,869,504 B2 * 12/2020 Mironov ..... A24F 40/465
(Continued)

FOREIGN PATENT DOCUMENTS

CN 203952405 U 11/2014
GB 2533080 A 6/2016
(Continued)

OTHER PUBLICATIONS

Korean Office Action issued on Aug. 12, 2022 in Korean Patent Application No. 10-2021-7001404 (with English translation), 12 pages.

(Continued)

*Primary Examiner* — Alexander Gilman
(74) *Attorney, Agent, or Firm* — Oblon, McClelland, Maier & Neustadt, L.L.P.

(57) ABSTRACT

A device for generating an aerosol is provided, including: a heating chamber including first and second regions and being configured to receive an article for forming an aerosol, the first region being adjacent or spaced from the second region; a first induction coil configured to generate a magnetic field to heat the article received in the heating chamber, the first induction coil being arranged to selectively generate the magnetic field, in use, to heat or to induce heating of the heating chamber; a second induction coil configured to generate a magnetic field in the second region of the heating chamber; and electric circuitry configured to monitor per-
(Continued)

formance of one or both of the first induction coil and the second induction coil. A method of generating an aerosol is also provided.

16 Claims, 3 Drawing Sheets

(51) Int. Cl.
*A24F 40/53* (2020.01)
*A24F 40/57* (2020.01)

(58) Field of Classification Search
USPC ..... 131/329
See application file for complete search history.

(56) References Cited

U.S. PATENT DOCUMENTS

| | | | | |
|---|---|---|---|---|
| 11,013,872 | B2 * | 5/2021 | Silvestrini | A61M 15/0021 |
| 11,212,881 | B2 * | 12/2021 | Fursa | A24F 40/465 |
| 11,470,883 | B2 * | 10/2022 | Kaufman | A24F 40/50 |
| 2015/0208729 | A1 * | 7/2015 | Monsees | H02J 7/0034 131/329 |
| 2015/0230521 | A1 | 8/2015 | Talon | |
| 2015/0245669 | A1 * | 9/2015 | Cadieux | A24F 40/50 131/329 |
| 2016/0089508 | A1 * | 3/2016 | Smith | A61M 15/0085 128/202.21 |
| 2016/0150825 | A1 * | 6/2016 | Mironov | A24F 40/46 219/634 |
| 2016/0150828 | A1 * | 6/2016 | Goldstein | H05B 6/36 392/387 |
| 2016/0219938 | A1 * | 8/2016 | Mamoun | G05B 15/02 |
| 2016/0295921 | A1 * | 10/2016 | Mironov | A24F 40/465 |
| 2016/0309782 | A1 * | 10/2016 | Malgat | A24F 40/465 |
| 2017/0055585 | A1 * | 3/2017 | Fursa | H03F 3/2176 |
| 2017/0064996 | A1 * | 3/2017 | Mironov | H05B 6/108 |
| 2017/0071250 | A1 * | 3/2017 | Mironov | A24F 40/465 |
| 2017/0086508 | A1 * | 3/2017 | Mironov | A24F 40/46 |
| 2017/0119046 | A1 | 5/2017 | Kaufman et al. | |
| 2017/0119048 | A1 | 5/2017 | Kaufman et al. | |
| 2017/0119049 | A1 | 5/2017 | Blandino et al. | |
| 2017/0311648 | A1 | 11/2017 | Gill et al. | |
| 2018/0020730 | A1 * | 1/2018 | Alarcon | A24F 40/42 131/329 |
| 2018/0020735 | A1 | 1/2018 | Bilat et al. | |
| 2018/0029782 | A1 * | 2/2018 | Zuber | B65D 83/384 |
| 2018/0132531 | A1 * | 5/2018 | Sur | H05B 1/0244 |
| 2018/0168226 | A1 * | 6/2018 | Mironov | A24F 40/42 |
| 2018/0184713 | A1 * | 7/2018 | Mironov | A24F 40/30 |
| 2018/0192701 | A1 | 7/2018 | Stoner | |
| 2018/0228217 | A1 * | 8/2018 | Mironov | A24F 40/465 |
| 2019/0059448 | A1 | 2/2019 | Talon | |
| 2019/0274361 | A1 | 9/2019 | Bilat et al. | |
| 2020/0221775 | A1 * | 7/2020 | Mironov | H05B 6/44 |
| 2020/0229512 | A1 * | 7/2020 | Israel | H05B 3/46 |
| 2021/0204603 | A1 * | 7/2021 | Taurino | H05B 6/44 |
| 2021/0307399 | A1 * | 10/2021 | Batista | A24F 40/51 |

FOREIGN PATENT DOCUMENTS

| | | | |
|---|---|---|---|
| KR | 10-2015-0064754 | A | 6/2015 |
| KR | 10-2018-0073626 | A | 7/2018 |
| RU | 2 517 125 | C2 | 5/2014 |
| RU | 2 605 837 | C2 | 12/2016 |
| RU | 2 653 467 | C2 | 5/2018 |
| RU | 2016 138 699 | A | 6/2018 |
| WO | WO 2014/058678 | A1 | 4/2014 |
| WO | WO 2015/177265 | A1 | 11/2015 |
| WO | WO 2017/068098 | A1 | 4/2017 |
| WO | WO 2017/109448 | A2 | 6/2017 |
| WO | WO 2018/019533 | A1 | 2/2018 |
| WO | WO 2018/073376 | A1 | 4/2018 |
| WO | WO 2018/096000 | A1 | 5/2018 |
| WO | WO 2018/138072 | A1 | 8/2018 |

OTHER PUBLICATIONS

European Office Action mailed on Mar. 12, 2024 issued in European Patent Application No. 19 742 607.5 filed on Jul. 24, 2019, total 6 pages.

Combined Russian Office Action and Search Report issued Jul. 1, 2021 in Russian Patent Application No. 2021101567 (with English translation), 17 pages.

Japanese Office Action issued Feb. 14, 2022 in Japanese Patent Application No. 2020-569895 (with English translation), 15 pages.

International Search Report and Written Opinion issued on Oct. 25, 2019 in PCT/EP2019/069930 filed on Jul. 24, 2019.

Japanese Notice of Reasons for Refusal mailed on Apr. 23, 2024, issued in Japanese Patent Application No. 2022-191010 filed on Nov. 30, 2022, with English Translation. total 7 pages.

* cited by examiner

SYSTEM FOR GENERATING AN AEROSOL

This invention relates generally to a system for generating an aerosol and to a method of use thereof.

Devices for generating aerosols which heat rather than combust an aerosol-forming substrate have previously been proposed in the art. For example, heated smoking devices in which tobacco is heated rather than combusted, have been proposed. One aim of such smoking devices is to reduce the generation of undesirable smoke constituents of the type produced by the combustion and pyrolytic degradation of tobacco in conventional cigarettes. These heated smoking devices are commonly known as 'heat not burn' devices.

Heated smoking devices of the above-described type commonly comprise a heating chamber, provided with, e.g. defined by, heating surfaces, into which an article for forming an aerosol is inserted, prior to use. The article for forming an aerosol typically contains an aerosol-forming substrate which is subsequently heated by a heater of the device to generate an aerosol. In this way, when the aerosol-forming substrate contained in an article has been exhausted the article can be replaced, with the heated smoking device thereby constituting a reusable device whilst the article comprises a 'consumable' product. The articles for forming an aerosol are normally shaped and sized to mimic conventional cigarettes. Accordingly, the articles, and the heating chamber in the heated smoking device into which they are inserted or insertable, have a generally cylindrical shape. Typically, the diameter of the articles is from 5 to 10 mm, say about 7.2 mm.

Articles for forming an aerosol of the above-described type typically have a wrapper or carrier layer within which the aerosol-forming substrate is retained. Filter material is generally provided at one or both of the ends of the article, serving as a plug to retain the aerosol-forming substrate within the article and, also, to filter aerosol generated by the heated smoking device, in use. Additionally, an aerosol-cooling element (which may be formed from a gathered sheet of polylactic acid, for example) may be located within the article, between the aerosol-forming substrate and the filter at one end of the article. A support element (for example formed from a hollow acetate tube) may additionally be positioned between the aerosol-forming substrate and the aerosol-cooling element.

In use, a user inserts an article between the heating surfaces of the heating chamber of a heated smoking device. The user then draws air through a free end of the article (said free end comprising filter material). The heater within the heated smoking device is activated to transfer thermal energy to the article for forming an aerosol, thereby releasing volatile compounds from the aerosol-forming substrate. Air is drawn into the heated smoking device by the user drawing on the article for forming an aerosol. The air flows through at least part of the device and then into and along the length of the article, passing through the aerosol-forming substrate and drawing released volatile compounds therefrom along with it. The air flow and volatile compound mixture then passes through the cooling segment, where the volatile compounds cool and condense into an aerosol. This aerosol then passes through the filter material before being drawn into the lungs of the user. The wrapper or carrier layer acts as a baffle during this process and serves to direct the air flow causing it to flow through and along the article to the user.

Heating an aerosol-forming substrate, rather than combusting it, requires that the aerosol-forming substrate is heated to a relatively reduced temperature. Accordingly, a relatively reduced quantity of thermal energy need be transferred to the aerosol-forming substrate. The energy saved beneficially reduces the expense of operating the heated smoking device. Nevertheless, it would be beneficial to yet further reduce the quantity of thermal energy required to volatilize compounds from an article for forming an aerosol.

Furthermore, heating rather than combusting an aerosol-forming substrate may result in a more efficient use of the substrate, thereby requiring relatively reduced quantities of it, with consequential cost savings. However, in prior art articles for 'heat not burn' devices a portion of the aerosol-forming substrate remains un-volatilized after use, thereby providing a waste of materials.

As will be appreciated, articles for forming an aerosol may be provided in different configurations (e.g. shapes and/or sizes), have different types and/or forms of aerosol-forming substrate and/or may be in different conditions (e.g. new, used or partially used). Articles for forming an aerosol of different types, configurations and/or conditions may respond differently to heating, both at different temperatures, different durations of applied temperatures and/or for different quantities of transferred thermal energy. Accordingly, the user experience when heating such different articles in the heating chamber of a heated smoking device may be variable and, indeed, may be sub-optimal and even unpleasant to the user, dependent on the type, configuration and/or condition of article used.

As used herein, the term 'and/or' is used to refer to either one of two stated options or both of two stated options. For example, A and/or B is used to refer to either one of A and B or both A and B. Further, the phrase 'at least one of A and B' falls within the definition of 'A and/or B'.

It would be desirable to provide a device for generating an aerosol which is improved over prior art devices for generating an aerosol. It would be desirable to provide a device for generating an aerosol which mitigates one or more of the above-identified issues. It would be desirable to provide a device for generating an aerosol which provides an improved user experience when heating a variety of types, configurations and/or conditions of articles for forming an aerosol. It would also be desirable to provide a device for generating an aerosol which requires a relatively reduced quantity of energy to generate aerosol from an article for forming an aerosol, when received in a heating chamber of the device.

There is provided a device for generating an aerosol. The device may comprise a heating chamber for receiving an article for forming an aerosol. The device may comprise an induction coil for generating a magnetic field for heating an article for forming an aerosol received in the heating chamber. The device may comprise electric circuitry configured to monitor the performance of the induction coil.

According to the invention, there is provided a system for generating an aerosol. The system comprises a device for generating aerosol and an article for forming an aerosol. The device comprises a heating chamber for receiving an article for forming an aerosol and an induction coil for generating a magnetic field for heating an article for forming an aerosol received in the heating chamber. The heating chamber comprises first and second regions. The induction coil is arranged to selectively generate a magnetic field, in use, for heating of or inducing heating in only the first region of the heating chamber.

The induction coil may be arranged to selectively generate a magnetic field, in use, for heating of and inducing heating in only the first region of the heating chamber.

According to the invention, there is provided a system for generating an aerosol. The system may comprise a device for generating aerosol and an article for forming an aerosol. The device may comprise a heating chamber for receiving an article for forming an aerosol and an induction coil for generating a varying magnetic field for heating an article for forming an aerosol received in the heating chamber. The heating chamber may comprise first and second regions. The induction coil may be arranged to selectively generate a varying magnetic field, in use, for heating of or inducing heating in only the first region of the heating chamber.

Advantageously, monitoring of the performance of the induction coil provides a device for generating an aerosol which generates aerosol relatively more efficiently than is the case with prior art devices. Monitoring the performance of the induction coil may allow relatively more accurate control of the duration of and/or quantity of thermal energy supplied to an article for forming an aerosol received within the heating chamber of the device.

Furthermore, the supply of thermal energy can be more readily tailored to the type, configuration and/or condition of the article for forming an aerosol received in the heating chamber of the device. Without wishing to be bound by any particular theory, it is believed that the performance of an induction coil varies according to the type, configuration and/or condition of an article for forming an aerosol received in the heating chamber. For example, the transfer of energy from the induction coil of the device to a susceptor of the article may have its greatest efficiency when the operating frequency of the induction coil is equal to or greater than a resonant frequency of the induction coil in concert with the susceptor. When the operating frequency of the induction coil is at or above the resonant frequency of the induction coil and susceptor power transfer therebetween is relatively greater. Accordingly, adjustment of the operating frequency of the induction coil to equal or exceed the resonant frequency may enhance heating of the article and, therefore, generation of aerosol therefrom. Further, by monitoring the performance of the induction coil it may be possible to determine whether or not the operating frequency has reached the resonant frequency. Characteristics of an article received in the heating chamber of the device (for example the resonant frequency of the susceptor in concert with the induction coil) may therefore be determined, which may allow a relatively improved user experience of generating an aerosol with the device.

A 'susceptor' refers to an element that heats up when subjected to a varying or alternating magnetic field. Usually, a susceptor is conductive, and heating of the susceptor is the result of eddy currents being induced in the susceptor or hysteresis losses. Both hysteresis losses and eddy currents can occur in a susceptor. A susceptor may include graphite, molybdenum, silicon carbide, stainless steels, niobium, aluminium and any other conductive elements. Preferably, the susceptor element is a ferrite element. The material and the geometry for the susceptor may be chosen to provide a desired electrical resistance and heat generation.

In the operation of an induction heater, a high frequency alternating current is passed through one or more induction coils to generate one or more corresponding varying or alternating magnetic fields that induce a voltage in a susceptor of an article. The induced voltage causes a current to flow in the susceptor and this current causes Joule heating of the susceptor that in turn heats the aerosol-forming substrate. If the susceptor is ferromagnetic, hysteresis losses in the susceptor may also generate heat.

The term 'high frequency' denotes a frequency ranging from about 500 Kilohertz (KHz) to about 30 Megahertz (MHz) (including the range of 500 KHz to 30 MHz), in particular from about 1 Megahertz (MHz) to about 10 MHZ (including the range of 1 MHz to 10 MHz), and even more particularly from about 5 Megahertz (MHz) to about 7 Megahertz (MHz) (including the range of 5 MHz to 7 MHz).

Throughout the present disclosure, the term 'magnetic field' may refer to a varying or alternating magnetic field.

Throughout the present disclosure, the term 'current' may refer to an alternating current.

As used herein, the phrase 'aerosol-forming substrate' is used to describe a substrate capable of releasing upon heating volatile compounds, which can form an aerosol. The aerosol generated from aerosol-forming substrates described herein may be visible or invisible to the human eye. The aerosol-forming substrate may comprise a solid, a fluid or a mixture of solid and fluid substrate. Where the aerosol-forming substrate is a fluid it is advantageously retained within a matrix and/or by a cover layer, at least prior to receipt of the aerosol-forming substrate in the heating chamber.

As used herein, the term 'aerosol' is used to describe a suspension of relatively small particles in a fluid medium.

As used herein, the phrase 'heating chamber' is used to mean a space within which an article for forming an aerosol comprising an aerosol-forming substrate is received or receivable and is heated or heatable. The first and second major boundary surfaces at least partially define the periphery of the heating chamber.

As used herein, the phrase 'monitor the performance of the induction coil' is used to mean that one or more characteristics of the induction coil are directly or indirectly monitored. For example, the electrical current flowing into, through and/or from the induction coil may be monitored, directly and/or indirectly. Additionally or alternatively, characteristics of one or more further elements (for example of the heating chamber and/or of an article received therewithin) may be monitored, e.g. such that the performance of the induction coil may be indirectly monitored.

In some embodiments, the heating chamber comprises first and second regions. The induction coil may be arranged to selectively generate a magnetic field, in use, for example for heating of and/or inducing heating in only the first region of the heating chamber.

According to the invention there is provided, a device for generating an aerosol, the device comprising: a heating chamber for receiving an article for forming an aerosol; and an induction coil for generating a magnetic field for heating an article for forming an aerosol received in the heating chamber, the heating chamber comprising first and second regions, the induction coil being arranged to selectively generate a magnetic field, in use, for heating of and/or inducing heating in only the first region of the heating chamber.

In some embodiments, the device may comprise electric circuitry, for example configured to monitor the performance of the induction coil. Throughout the present disclosure, the terms 'electric' and 'electronic' may be used interchangeably.

In some embodiments, the first and second regions may have substantially the same shape and/or volume. The first region may be adjacent or spaced from the second region. In some embodiments the heating chamber may consist of the first and second regions.

The heating chamber may comprise a primary flow axis, for example for flow of fluid through the heating chamber, in use. The heating chamber may comprise a first major boundary surface. The heating chamber may comprise a second major boundary surface. The first and/or second major boundary surface may be substantially flat. The first and second major boundary surfaces may extend in facing parallel relations. The first and second major boundary surfaces may define the primary flow axis. The first region may be upstream or downstream of the second region, e.g. along the primary flow axis. The heating chamber may comprise an upstream end, e.g. and a downstream end. The heating chamber may be configured or arranged such that fluid flows, in use, from the upstream end to or toward the downstream end (e.g. along the primary flow axis). The heating chamber may have a non-round cross-section, for example perpendicular to the longitudinal direction and/or the primary flow axis. The first region may be at or adjacent the upstream end of the heating chamber, for example and may be spaced from the downstream end thereof. The second region may be at or adjacent the downstream end of the heating chamber, for example and may be spaced from the upstream end thereof.

In some embodiments, the electric circuitry may be configured to control (e.g. to alter or stop) the induction coil generating a magnetic field, e.g. based on a monitored performance of the induction coil. In some embodiments, the electric circuitry may be configured to control (e.g. alter or stop) the induction coil generating a magnetic field for heating of and/or inducing heating in the first region (where provided) of the heating chamber. In some embodiments, the electric circuitry may be configured to start the induction coil generating a magnetic field for heating of and/or inducing heating in the second region (where provided) of the heating chamber, for example after generation of a magnetic field for heating of and/or inducing heating in the first region has been controlled (e.g. altered or stopped).

Advantageously, controlling (e.g. altering or stopping) the induction coil generating a magnetic field may improve a user experience of the device. For example, the electric circuitry may stop a used or damaged article from being heated in the device. Additionally or alternatively, the electric circuitry may stop an article having an incorrect configuration (e.g. incompatible configuration—for example an incorrect location, size, shape, etc. of susceptor) being heated in the device. The electric circuitry may thereby, beneficially, stop heating of counterfeit or otherwise undesirable articles in the heating chamber of the device. Additionally or alternatively, the electric circuitry may alter the magnetic field generated by the induction coil to heat an article received in the heating chamber of the device more efficiently and/or with a more desirable heating regime (e.g. which may enhance the user experience).

In some embodiments, the electric circuitry may be configured to monitor (e.g. directly or indirectly) a current flowing to and/or through and/or from the induction coil. The electric circuitry may comprise a current sensor, for example arranged to measure the current flowing to and/or through and/or from the induction coil. The current sensor may comprise a hall effect sensor and/or a shunt resistor and/or a current transformer and/or a fluxgate current sensor and/or any other suitable type of current sensor.

In some embodiments, the electric circuitry may be configured to control (e.g. alter or stop) the induction coil generating a magnetic field when a monitored current flowing through the induction coil differs from an expected or desired (e.g. reference) current. The electric circuitry may be configured to control (e.g. alter or stop) the induction coil generating a magnetic field when the monitored current flowing through the induction coil is less than, equal to or greater than the expected or desired (e.g. reference) current. The electric circuitry may be configured to control (e.g. alter or stop) the induction coil generating a magnetic field when the monitored current flowing through the induction coil differs from the expected or desired (e.g. reference) current for a duration equal to or greater than a predetermined time period. The electric circuitry may comprise a switch configured to selectively allow or prevent electrical energy from reaching the induction coil, for example to control (e.g. alter or stop) the induction coil generating a magnetic field.

The expected or desired (e.g. reference) current may comprise a threshold current, for example a pre-set threshold current. The expected or desired (e.g. reference) current may comprise a current range. The expected or desired (e.g. reference) current may comprise a threshold rate of change of current over time, for example a pre-set threshold rate of change of current over time. The expected or desired (e.g. reference) current may comprise a current profile, for example a plot or graph of current relative to voltage and/or time.

The predetermined time period may comprise any suitable time period, for example 10 seconds, 9, 8, 7, 6, 5, 4, 3, 2, 1 seconds or less. The predetermined time period may comprise less than 1000 milliseconds, for example less than 900, 800, 700, 600, 500, 400, 300, 200, 100, 75, 50, 25, 20, 15, 10 or 5 milliseconds.

In some embodiments, the electric circuitry may be configured to monitor the temperature of the heating chamber and/or of an article for forming an aerosol received in the heating chamber. The electric circuitry may comprise a temperature sensor, for example arranged to measure the temperature of the heating chamber and/or of an article for forming an aerosol received in the heating chamber. The temperature sensor may comprise one or more temperature sensors. The temperature sensor may comprise a contact and/or non-contact sensor. The temperature sensor may comprise a thermostat, a thermistor, a resistive temperature detector and/or a thermocouple.

The electric circuitry may be configured to control (e.g. alter or stop) the induction coil generating a magnetic field when a monitored temperature of the heating chamber and/or an article for forming an aerosol received therein differs from an expected or desired (e.g. reference) temperature. The electric circuitry may be configured to control (e.g. alter or stop) the induction coil generating a magnetic field when a monitored temperature of the heating chamber and/or an article for forming an aerosol received therein is less than, equal to or greater than an expected or desired (e.g. reference) temperature. The electric circuitry may be configured to control (e.g. alter or stop) the induction coil generating a magnetic field when the monitored temperature of the heating chamber and/or an article for forming an aerosol received therein differs from the expected or desired (e.g. reference) temperature for a duration equal to or greater than a predetermined time period.

The expected or desired (e.g. reference) temperature may comprise a threshold temperature, for example a pre-set threshold temperature. The threshold temperature may be 400 degrees centigrade, for example, 300, 270, 250, 225, 200, 175, 150, 140, 130, 120, 110, 100 or 90 degrees centigrade. The expected or desired (e.g. reference) temperature may comprise a temperature range, for example between about 90 and 400 degrees centigrade, say between about 100, 110, 120, 130, 140, 150, 175, 200, 225, 250, 270 or 300 and 400 degrees centigrade. The expected or desired (e.g. reference) temperature may comprise a threshold rate of change of temperature over time, for example a pre-set threshold rate of change of temperature over time. The expected or desired (e.g. reference) temperature may comprise a temperature profile, for example a plot or graph of temperature relative to voltage and/or current and/or time.

In some embodiments, the electric circuitry may be configured to prevent reactivation of the induction coil, for example after generation of a magnetic field by the induction coil has been stopped (e.g. unless and/or until a replacement article for forming an aerosol is received in the heating chamber).

In some embodiments, the induction coil may comprise first and second induction coils. The first induction coil may be arranged or configured or configurable to generate a magnetic field in the first region (e.g. only) of the heating chamber. The second induction coil may be arranged or configured or configurable to generate a magnetic field in the second region (e.g. only) of the heating chamber. The electric circuitry may be configured to control (e.g. alter or stop) the first and/or second induction coil from generating a magnetic field, e.g. based on a monitored performance of the first and/or second induction coil.

The electric circuitry may be configured or configurable to alter or adjust the operating frequency of the induction coil. Where plural induction coils (that is, a plurality of induction coils) are provided the electric circuitry may be configured or configurable to alter or adjust the operating frequency of one, some or each induction coil, for example separately or together. Where plural induction coils are provided the electric circuitry may be operable or operated to generate a magnetic field with one induction coil at a different operating frequency to that used to generate a magnetic field from one or more of the other induction coils.

The electric circuitry may comprise one or more inverters, for example configured or configurable to generate an alternating current (e.g. from a direct current).

In some embodiments, the device may comprise a susceptor altering means or mechanism, for example arranged or configured or configurable to alter the operation of a susceptor of an article for forming aerosol received in the heating chamber. The susceptor altering means may comprise mechanical, thermal and/or chemical means for altering the operation of the susceptor. The susceptor altering means or mechanism may be arranged or configured or configurable to alter a susceptor of an article for forming an aerosol received in the heating chamber. The susceptor altering means or mechanism may be arranged or configured to alter the condition of a susceptor, e.g. to deform and/or break a susceptor of an article for forming an aerosol received in the heating chamber, for example a susceptor thereof. The electric circuitry may be configured or configurable to operate the susceptor altering means or mechanism, for example to alter the condition of a susceptor of an article for forming an aerosol received in the heating chamber. The electric circuitry may be configured or configurable to operate the susceptor altering means or mechanism to alter the condition of a susceptor of an article for forming an aerosol received in the heating chamber after and/or if the generation of a magnetic field by the induction coil is or has been controlled (e.g. altered or stopped). The susceptor altering means or mechanism may comprise a hook. The susceptor altering means or mechanism may be operable to move between an engaged and disengaged position. In the engaged position the susceptor altering means or mechanism may engage and/or contact a portion (e.g. a susceptor) of an article for forming an aerosol received in the heating chamber. In the disengaged position the susceptor altering means or mechanism may be clear of an article for forming aerosol received in the heating chamber. Altering the article may comprise moving the susceptor altering means or mechanism from the engaged to the disengaged position. The susceptor altering means or mechanism may comprise heating, e.g. overheating an article received in the heating chamber. For example, the susceptor altering means or mechanism may comprise heating an article received in the heating chamber to an alteration temperature, for example which may be greater than the normal operating temperature of heating the article (e.g. the temperature at which volatile compounds are released from the article). The alteration temperature may be configured or selected to alter (e.g. directly or indirectly) the shape and/or size and/or condition of a susceptor of an article received in the heating chamber. In some embodiments, the alteration temperature may be configured or selected to alter the shape and/or size and/or condition of aerosol-forming substrate of an article received in the heating chamber, for example and to thereby alter the shape, size and/or condition of a susceptor of the article.

In some embodiments, the device may comprise a trigger means or mechanism for activating the device, for example for activating the generation of aerosol by the device. The trigger means or mechanism may comprise a manually operated or operable actuator or activator, for example a switch or button. Additionally or alternatively, the trigger means or mechanism may comprise an automatically operated or operable actuator or activator, for example a switch actuated by a threshold pressure or flow rate of fluid. In some embodiments, the device may comprise a check or one-way valve configured or configurable to restrict flow through or within the device to a single direction, for example configured or configurable to allow inhalation through the device and to prevent exhalation through the device. Inhalation through the device may comprise flow of fluid (e.g. air) toward the first end, where provided. Exhalation through the device may comprise flow of fluid (e.g. air) toward the second end, where provided.

The resistance to draw (RTD) of the device for generating an aerosol with an article for forming an aerosol received in the heating chamber may be between approximately 80 mmWG and approximately 140 mmWG. As used herein, resistance to draw is expressed with the units of pressure 'mmWG' or 'mm of water gauge' and is measured in accordance with ISO 6565:2002.

The device may comprise a cooling chamber, for example in fluid communication with the heating chamber. The cooling chamber may be in fluid communication with the mouthpiece or mouthpiece end of the device (where provided). The cooling chamber may be configured or configurable to cool a mixture of fluid and volatilized compounds flowing thereinto. The cooling chamber may have a relatively greater cross-sectional area (e.g. perpendicular to a direction of flow into the cooling chamber) than the cross-sectional area of the heating chamber (e.g. perpendicular to the principal flow axis).

In some embodiments, the device may be configured to recognise an article for forming an aerosol, for example a type or kind of article for forming an aerosol.

According to the invention, there is provided a device for generating an aerosol from an article for forming an aerosol, the device being configured to recognise or identify an article for forming an aerosol, for example a type or kind of article for forming an aerosol.

In some embodiments, the device may be configured or arranged to selectively allow or prevent heating of the article for forming an aerosol. In some embodiments, the device may be configured or arranged to selectively allow heating of the article for forming an aerosol e.g. when the article for forming an aerosol has been recognised or identified (e.g. as suitable). In some embodiments, the device may be configured or arranged to selectively prevent heating of the article for forming an aerosol, e.g. when the article for forming an aerosol has not been recognised or identified (for example or has been identified as being unsuitable).

The device may be configured to recognise or identify an article for forming an aerosol based on one or more parameter of the article. Suitable parameters may comprise: the size of the article; the shape of the article; the volume of the article; one or more dimension of the article; the density of one or more part of the article; a mass or weight of the article or a part thereof; one or more tags or markings in and/or on the article, whether visible or otherwise (for example revealed upon exposure to a specific wavelength of electromagnetic irradiation and/or chemical and/or temperature and/or pressure); the permeability of at least part of the article; a material property of the article or a portion thereof; a strength and/or location and/or direction of magnetism of the article or a portion thereof; a capacitance of the article or a portion thereof; an electrical resistance of the article or a portion thereof; and the like.

According to the invention, there is provided a system for generating an aerosol, the system comprising a device for generating an aerosol as described herein and an article for forming an aerosol.

In some embodiments, the article for forming an aerosol may be shaped to closely conform to the heating chamber, for example to the shape and/or dimensions of the heating chamber. Additionally or alternatively, the article for forming an aerosol may comprise one or more extension parts configured (e.g. dimensioned and/or shaped) to extend from the heating chamber, when received therewithin. The extension part(s) may be attached or connected to a main part of the article for forming an aerosol. The extension part(s) may extend from a side, edge or end of the article for forming an aerosol. The article for forming an aerosol may be generally parallelepiped in shape. The article for forming an aerosol may have a width, a length and a thickness. The thickness may be less than both the width and the length. The article may have a non-round cross-section. The article may have a first major surface which is substantially flat. The article may have a second major surface which is substantially flat. The first and second major surfaces may be substantially parallel to one another, for example may extend in generally parallel relations. The article may comprise an upstream end. The article may comprise a downstream end. The article may be configured or arranged such that, when it is inserted into the heating chamber of a device for forming an aerosol, fluid is flowable through the article (for example from the upstream end to the downstream end). The article may have a non-round cross-section, for example where the cross-section is perpendicular to a longitudinal direction of the article (e.g. a direction extending from the upstream to downstream ends of the article). The article may comprise first and second regions, for example which may be configured to align with the first and second regions, respectively, of the heating chamber (when the article is inserted therein).

Advantageously, provision of a non-round cross-section reduces the number of relative orientations by which the article may be inserted into the heating chamber of the device for forming an aerosol (where the article is shaped to closely conform to the heating chamber). Accordingly, the article may be aligned more rapidly and easily by a user of the device in an intended or desired orientation with the device (which may otherwise prove difficult). Beneficially, elements of the article may therefore be correctly aligned with elements of the device, which may enhance the efficiency of use of the article in the device (for example of heating of the article in the device). Insertion of the article into the device may therefore be made easier for a user thereof.

In some embodiments, the article may comprise one or more metal elements (for example susceptors). The, one, some or each of the one or more metal elements may be located in and/or on the article (for example the aerosol-forming substrate). The, one, some or each of the one or more metal elements may be located in and/or on the first and/or second region of the aerosol-forming substrate (where first and second regions are provided). One of the first and second regions may be from of metal elements. Said one or more metal elements may extend at least partially along the length of the article. Said one or more metal elements may extend across at least partially across the width of the article. Said one or more metal elements may extend through the thickness of the article. Said one or more metal elements may have any suitable shape, for example: a loop, a coil, a strip, a sphere, a strand, a particle, irregular shaped and the like. Said one or more metal elements may comprise a metallic shell or cover layer of any suitable shape (for example as described above) surrounding a non-metallic material and/or which may be hollow.

The aerosol-forming substrate may comprise nicotine. The aerosol-forming substrate may comprise tobacco. Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate.

If the aerosol-forming substrate is in the form of a fluid, for example a liquid or a gas, the aerosol-forming substrate may contain tobacco or non-tobacco volatile flavour compounds, which are released upon heating of the fluid aerosol-forming substrate.

Optionally, the solid or fluid aerosol-forming substrate may be provided on or embedded in a thermally stable carrier. The carrier may take the form of powder, granules, pellets, shreds, strands, strips or sheets. The solid or fluid aerosol-forming substrate may be deposited throughout the carrier, e.g. throughout the volume thereof. Alternatively, the solid or fluid aerosol-forming substrate may be deposited on the surface of the carrier in the form of, for example, a sheet, foam, gel or slurry. The solid or fluid aerosol-forming substrate may be deposited on the entire surface of the carrier, or alternatively, may be deposited in a pattern in order to provide a non-uniform flavour delivery during use.

The article for forming an aerosol may comprise a volatile flavour-generating component. Where provided, the or each extension part of the aerosol-forming substrate may comprise a volatile flavour-generating component.

As used herein the term 'volatile flavour-generating component' is used to describe any volatile component that is added to an aerosol-forming substrate in order to provide a flavourant.

The volatile flavour-generating component may be in the form of a liquid or a solid. The volatile flavour-generating compound may be coupled to, or otherwise associated with, a support element. The support element may comprise any suitable substrate or support for locating, holding, or retaining the flavour-generating component. For example, the support element may comprise a fibrous support element, which may be saturated or saturatable with fluid, for example a liquid.

In some embodiments, the volatile flavour-generating component may have any suitable structure in which a structural material releasably encloses a flavourant or flavourants. For example, in some preferred embodiments, the volatile flavour-generating component comprises a matrix structure defining a plurality of domains, the flavourant being trapped within the domains until released, for example, when the aerosol-forming substrate is subject to external force. Alternatively, the volatile flavour-generating component may comprise a capsule. Preferably, the capsule comprises an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule.

If the volatile flavour-generating component comprises a matrix structure defining a plurality of domains enclosing the flavourant, the flavourant delivery member may release the flavourant steadily when the aerosol-forming substrate is subject to external force. Alternatively, if the volatile flavour-generating component is a capsule arranged to rupture or burst to release the flavourant when the article for forming an aerosol is subject to external force (for example, but not limited to, if the capsule comprises an outer shell and an inner core), the capsule may have any desired burst strength. The burst strength is the force (exerted on the capsule from the outside of the aerosol-forming substrate) at which the capsule will burst. The burst strength may be a peak in the capsule's force versus compression curve.

The volatile flavour-generating component may be configured to release the flavourant in response to an activation mechanism. Such an activation mechanism may include the application of a force to the filter, a change in temperature in the filter, a chemical reaction, or any combination thereof.

Suitable flavourants include, but are not limited to, materials that contain natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool.

As used herein, the term 'menthol' is used to describe the compound 2-isopropyl-5-methylcyclohexanol in any of its isomeric forms.

Menthol may be used in solid or liquid form. In solid form, menthol may be provided as particles or granules. The term 'solid menthol particles' may be used to describe any granular or particulate solid material comprising at least approximately 80% menthol by weight.

Preferably, 1.5 mg or more of the volatile flavour-generating component is included in the aerosol-forming substrate.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-forming substrate. Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

According to the invention, there is provided a method of using a device for generating an aerosol, the method comprising:

a) providing a device for generating an aerosol, the device comprising a heating chamber, an induction coil and electric circuitry;
b) inserting an article for forming an aerosol into the heating chamber;
c) generating a magnetic field with the induction coil for heating the heating chamber and/or the article for forming an aerosol received therein; and
d) monitoring the performance of the induction coil using the electric circuitry.

In some embodiments, the method may comprise: e) controlling (e.g. altering or stopping) generation of the magnetic field by the induction coil using the electric circuitry, e.g. based on the monitored performance of the induction coil.

All scientific and technical terms used herein have meanings commonly used in the art unless otherwise specified. The definitions provided herein are to facilitate understanding of certain terms used frequently herein.

Throughout the description and claims of this specification, the words "comprise" and "comprising" and variations of them mean "including but not limited to", and they are not intended to (and do not) exclude other moieties, additives, components, integers or steps. Throughout the description and claims of this specification, the singular encompasses the plural, and vice versa, unless the context otherwise requires. In particular, where the indefinite article is used, the specification is to be understood as contemplating plurality as well as singularity, unless the context requires otherwise.

For the avoidance of doubt, any of the features described herein apply equally to any aspect of the invention. Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one aspect or embodiment of the invention are applicable to all aspects or embodiments, unless such features are incompatible.

The invention will now be further described, by way of example only, with reference to the accompanying drawings, in which.

Figure 1:
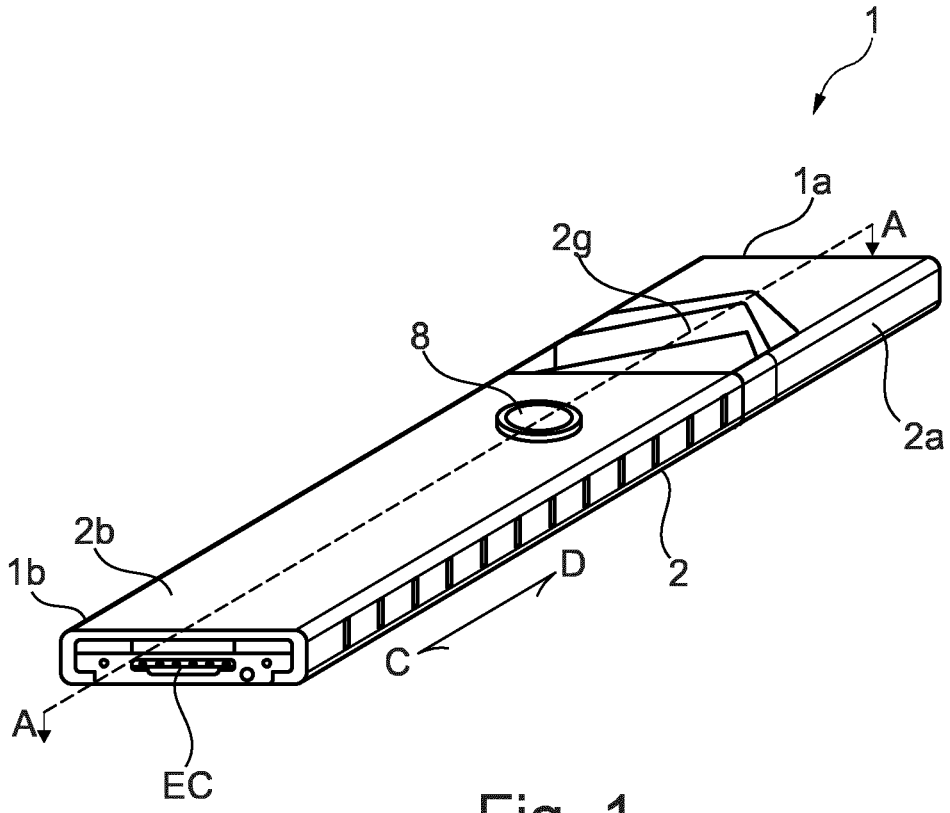
FIG. 1 is a schematic perspective view of a device for generating an aerosol according to an embodiment of the invention.
Figure 2:
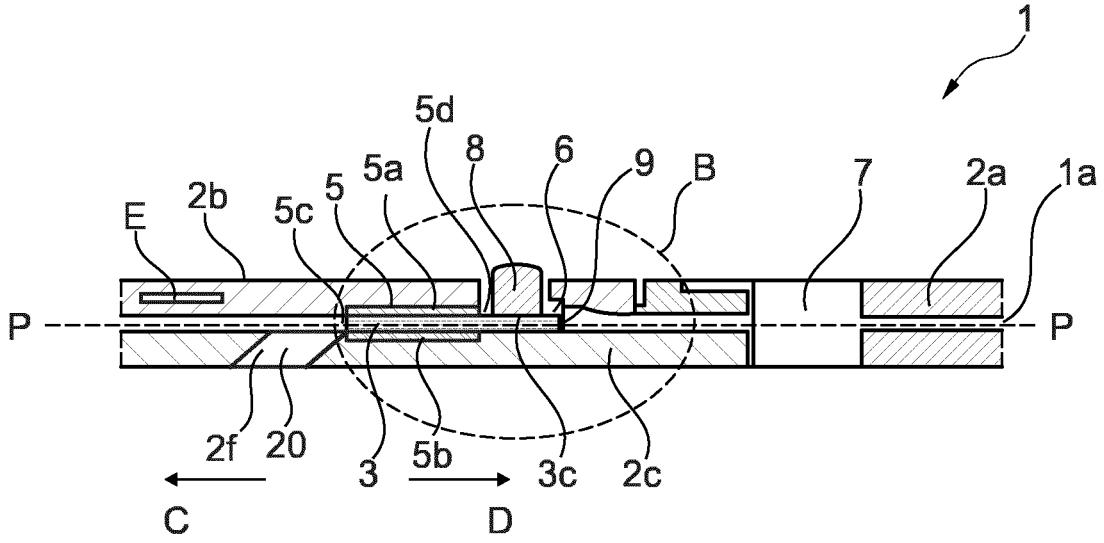
FIG. 2 is a partial cross-sectional view along plane A-A defined in FIG. 1.
Figure 3:
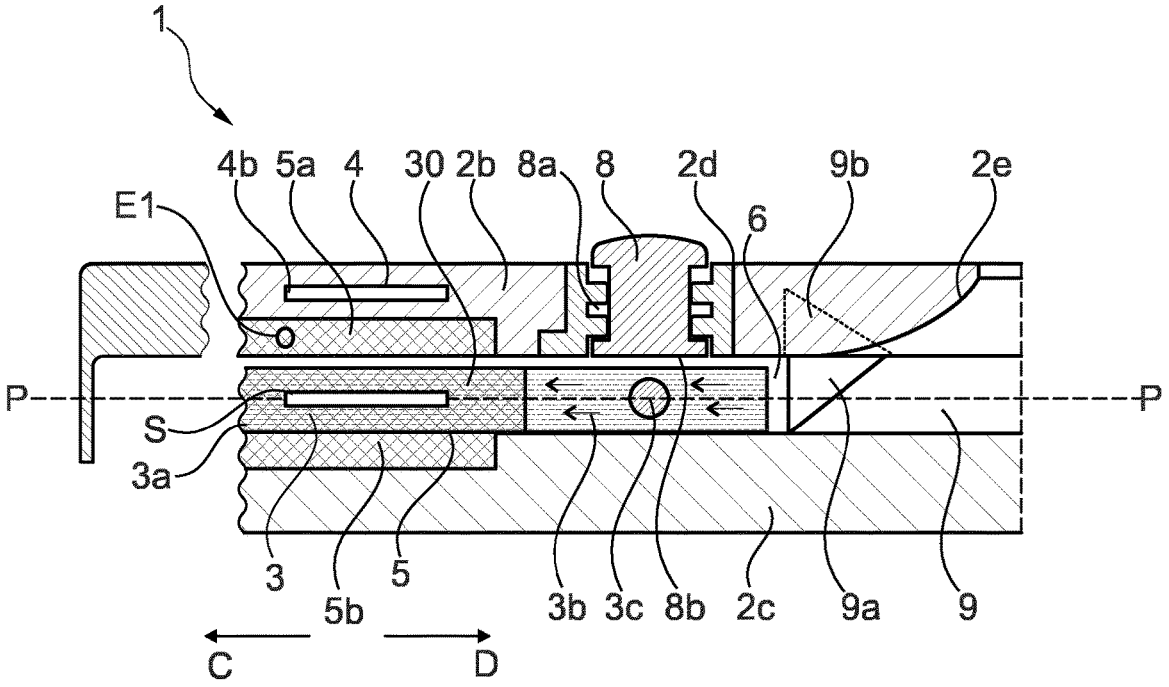
FIG. 3 is a close-up cross-sectional view of portion B from FIG. 2.

Referring now to FIGS. 1, 2 and 3, there is shown a device 1 for generating an aerosol, the device 1 comprising a first, mouthpiece end 1*a*, and a second, distal end 1*b* with a housing 2 extending therebetween. The device 1 has a generally parallelepiped shape, in this embodiment. The housing 2 is formed from a plastics material, in this embodiment, and may be moulded into the requisite shape, according to moulding techniques known in the art. In some embodiments, however, the housing 2 may be optional and, where provided, may have any suitable shape and may be formed from any suitable material and/or combination of materials.

The mouthpiece end 1*a* (which provides a downstream end) of the housing 2 comprises a mouthpiece 2*a* which is removably attached to the remainder of the housing 2 by push-fit. In some embodiments, however, the mouthpiece 2*a* may be integrally formed with the remainder of the housing 2. Alternatively, in some embodiments a mouthpiece 2*a* may not be provided.

The device 1 comprises electric circuitry E, which is located within the housing 2, in this embodiment. In some embodiments, however, the electric circuitry E may be disposed in any suitable location relative to the device 1. The distal end 1*b* of the device 1 includes optional electrical connections EC for connecting to (for example for programming) the electric circuitry E within the optional housing 2, for receiving data from a memory (not shown) within the housing 2 and/or for charging a power source (not shown) within the housing 2. The electrical connections EC may comprise one or more of a micro USB, USB-C or a bespoke connection. The distal end 1*b* of the device 1 may also comprise an alert mechanism (not shown), for example an audio device such as a speaker and/or a light source such as a light emitting diode (LED). The alert mechanism may be configured or configurable to alert a user of the device 1 to a change in the status of the device 1, for example that the power source requires charging.

An article 3 for forming an aerosol comprising aerosol-forming substrate 30 is shown in FIGS. 2 and 3, located in the device 1. However, as will be appreciated by one skilled in the art, the article 3 is separate from, and does not constitute part of, the device 1.

As best shown in FIGS. 2 and 3, the device 1 also comprises a heater 4, a heating chamber 5, an optional flavour-generation chamber 6 and an optional cooling chamber 7 located within the optional housing 2, between the mouthpiece and distal ends 1*a*, 1*b* of the device 1. The heating chamber 5 is directly adjacent to and in fluid communication with the optional flavour-generation chamber 6. The optional flavour-generation chamber 6 is in fluid communication with the cooling chamber 7, which is in turn in fluid communication with the mouthpiece end 1*b* of the device 1. An optional button 8 is located adjacent the optional flavour-generation chamber 6.

Figure 4:
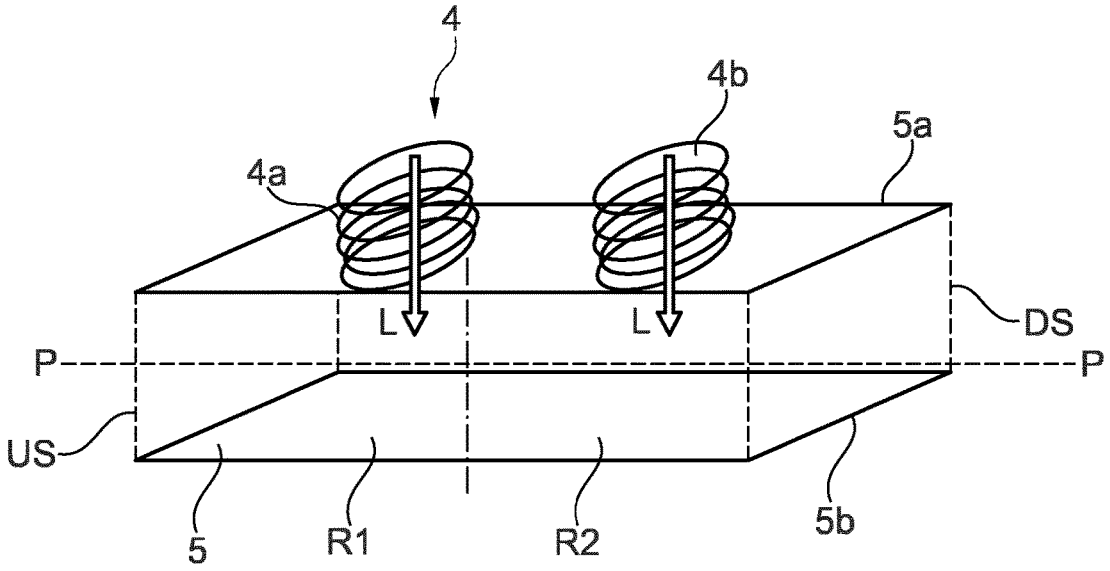
FIG. 4 is a schematic perspective view of a heating arrangement for use in a device for generating an aerosol according to an embodiment of the invention.

The heating chamber 5 comprises first and second major boundary surfaces 5*a*, 5*b*, in this embodiment. Further, minor, boundary surfaces (not shown) extend between the first and second major boundary surfaces 5*a*, 5*b*. The first and second major boundary surfaces 5*a*, 5*b* are substantially flat and are formed from a plastics material, in this embodiment. In some embodiments, however, the first and second major boundary surfaces 5*a*, 5*b* may be formed from any suitable material, for example from metal (e.g. from iron or an alloy thereof). The heating chamber 5 has a generally parallelepiped shape, in this embodiment. As shown in FIGS. 2 and 3, the device 1 is in a first, closed condition, in which the first and second major boundary surfaces 5*a*, 5*b* are in facing parallel relations. The first and second major boundary surfaces 5*a*, 5*b* define a principal flow axis P, from an upstream end US to a downstream end DS, for fluid flowing through the article 3 received therebetween. An inlet 5*c* is disposed at one end (the upstream end US) of the heating chamber 5, in fluid communication with the exterior of the housing 2. An outlet 5*d* is disposed at the opposed end (the downstream end DS) of the heating chamber 5. The principal flow axis P extends between, and is parallel to a flow path between, the inlet 5*c* and the outlet 5*d* (e.g. the upstream and downstream ends US, DS). The heating chamber 5 comprises first and second regions R1, R2 (as can be seen in FIG. 4). The first region R1 is adjacent the upstream end US of the heating chamber 5. The second region R2 is adjacent the downstream end DS of the heating chamber 5.

The heater 4 comprises first and second induction coils 4*a*, 4*b*. The induction coils 4*a*, 4*b* of the heater 4 are arranged to heat, in use, a susceptor S of an aerosol-forming substrate 3 received in the heating chamber 5 (as will be described in greater detail below). The induction coils 4*a*, 4*b* are embedded in the housing 2 in this embodiment, however in some embodiments the induction coils 4*a*, 4*b* may be located within a chamber of the housing 2, instead. As shown more clearly in FIG. 5, the longitudinal axis L of each induction coil 4*a*, 4*b* is substantially perpendicular to the principal flow axis P, such that the magnetic field M thereby generated (in use) is parallel to the principal flow axis P. The first induction coil 4*a* is configured to generate a magnetic field in the first region R1 of the heating chamber 5, in use. The second induction coil 4*b* is configured to generate a magnetic field in the second region R2 of the heating chamber 5, in use. The heater 4 is operatively connected or connectable to the power source.

The first major boundary surface 5*a* is attached to a first portion 2*b* of the housing 2, while the second major boundary surface 5*b* is attached to a second portion 2*c* of the housing 2. The first portion 2*b* of the housing 2, and hence the first major boundary surface 5*a*, is slidable relative to the second portion 2*c* of the housing 2 and the second major boundary surface 5*b* in a direction parallel to the principal flow axis P.

The first and second major boundary surfaces 5*a*, 5*b* may comprise corrugations having parallel peaks and troughs (not shown), in this embodiment. The peaks and troughs extend in a direction which is parallel to the principal flow axis P.

The first portion 2*b* of the housing 2 comprises an extension portion 2*d*, which extends outboard of the first major boundary surface 5*a* in a direction generally parallel thereto. The extension portion 2*d* is resiliently deformable in a direction perpendicular to a plane defined by the first major boundary surface 5*a*. The free end 2*e* of the extension portion 2*d* is tapered.

A removal aperture 2*f* extends through the second portion 2*c* of the housing 2, at a location upstream of the heating chamber 5. The removal aperture 2*f* is shaped and sized to allow, in use, a used article 3 to be removed from the device 1 therethrough. The removal aperture 2*f* is connected to the heating chamber 5 by a removal passageway 20. Guide surfaces of the removal aperture 2*f* are arranged to facilitate, in use, sliding removal of a used article 3 from the device 1. The guide surfaces extend in a direction at an acute angle to the principal flow axis P of the heating chamber 5. The guide surfaces are curved, in this embodiment. The removal aperture 2*f* may comprise an air inlet into the device 1. In some embodiments, the device 1 may comprise one or more additional or alternative air inlets extending through the housing 2 and fluidly communicating with the heating chamber 5.

The mouthpiece 2*a* comprises a transparent portion 2*g* in this embodiment (as shown in FIG. 1), through which aerosol generation can be viewed, during use of the device 1.

An abutment element 9 is movable within the device 1, relative to the housing 2, into and or out of the heating chamber 5. The abutment element 9 is configured to pull the article 3 out of the heating chamber 5. The abutment element 9 is located within a slot within the device 1, adjacent and coaligned with the optional flavour-generation chamber 6 and the heating chamber 5. The abutment element 9 and the extension portion 2*d* of the first portion 2*b* of the housing 2 comprise a coupling mechanism for releasably coupling the two components together. The coupling mechanism comprises an engagement member or catch 9*a* and a cooperating recess 9*b*. In the embodiment shown in FIGS. 2 and 3 the extension portion 2*d* comprises the recess 9*b* and the abutment element 9 comprises the engagement member or catch 9*a*. However, in some embodiments, the extension portion 2*d* may comprise the engagement member or catch 9*a* and the abutment element 9 may comprise the recess 9*b*. The engagement member or catch 9*a* is resiliently biased (for example by a spring) toward a position in which it engages with and into the recess 9*b*, thereby coupling the extension portion 2*d* and the abutment element 9 to one another.

The button 8 comprises a flavour releasing mechanism. The button 8 is disposed in a button aperture 8*a* which is located adjacent the optional flavour-generation chamber 6 and extends through the extension portion 2*d* of the first portion 2*b* of the housing 2. The button 8 is movable, in use, into and out of the optional flavour-generation chamber 6. The button 8 comprises a clamping surface 8*b* which is arranged to be movable, in use, against an article 3 located in the optional flavour-generation chamber 6. The button 8 comprises annular projections at or adjacent its ends. The button aperture 8*b* comprise first and second internal abutments, sized and located to engage with the annular projections of the button 8 to thereby retain the button 8 within the button aperture 8*b* whilst also allowing movement of the button 8 into and out of the optional flavour-generation chamber 6.

The cooling chamber 7 has a greater cross-sectional area (e.g. a greater height and/or width) perpendicular to a flow direction into the cooling chamber 7 than does the fluid flow passageway which fluidly connects the optional flavour-generation chamber 6 to the cooling chamber 7. The cooling chamber 7 also has a greater cross-sectional area (e.g. a greater height and/or width) perpendicular to a flow direction into the cooling chamber 7 than does the fluid flow passageway fluidly connecting the cooling chamber 7 to the mouthpiece end 1*a* of the device 1.

The electric circuitry E comprises a temperature sensor E1, in this embodiment, which is arranged to measure the temperature of the heating chamber 5 and/or of an article 3 received therein. Although the temperature sensor E1 is shown as being embedded in one of the major boundary surfaces 5*a* this need not be the case and, additionally or alternatively, the temperature sensor E1 may be located at any suitable location. In some embodiments, more than one temperature sensor E1 may be provided, for example where at least one of the plural temperature sensors E1 (that is, a plurality of temperature sensors) may be arranged to measure the temperature of the heating chamber 5 and at least one other of the plural temperature sensors E1 may be arranged to measure the temperature of an article 3 received within the heating chamber 5.

The electric circuitry E also comprises a current monitoring sensor, in this embodiment. The current monitoring sensor is configured to measure the current flowing through and/or to and/or from the first and second induction coils 4*a*, 4*b*. The electric circuitry comprises a processor which is operably connected to the temperature sensor E1 and the current monitoring sensor. The processor is also operably associated with the heater 4 and/or the power source, for selectively allowing or preventing supply of electrical energy to the heater 4. The processor is configured to receive temperature data from the temperature sensor E1 corresponding to the measured temperature of the heating chamber 5 and/or to the temperature of an article 3 received therein. The processor is configured to receive current data from the current monitoring sensor corresponding to the measured current flowing to, through and/or from the first and second induction coils 4*a*, 4*b*. The processor is also configured to compare the received temperature data and current data with expected or desired (e.g. reference) temperature data and expected or desired (e.g. reference) current data. In some embodiments, the expected or desired (e.g. reference) temperature data and/or current data may be stored in the device 1.

Figure 5:
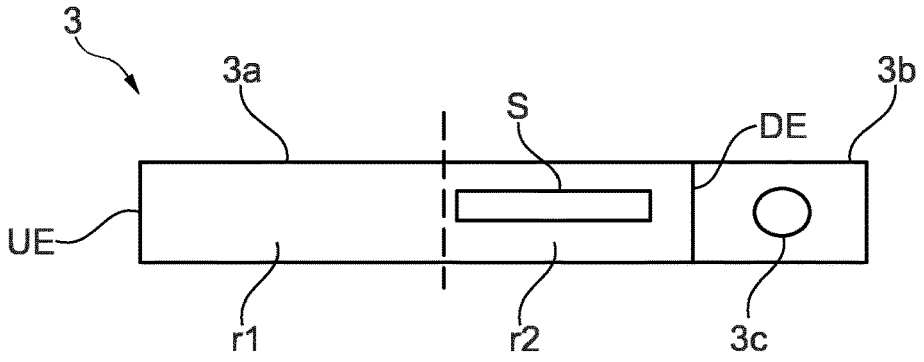
FIG. 5 is a schematic side view of the article for forming an aerosol for use in the device for generating an aerosol shown FIG. 1.

As shown in greater detail in FIG. 5, the article 3 for forming an aerosol comprises a main part 3*a* and an optional extension part 3*b* extending therefrom. The main part 3*a* is sized and shaped to closely conform to the size and shape of the heating chamber 5 when disposed therewithin. The main part 3*a* comprises aerosol-forming substrate 30 in the form of a matrix material within which a liquid aerosol-forming substrate 30 is retained, in this embodiment. The main part 3*a* of the article 3 has an upstream end UE and a downstream end DE, from which the optional extension part 3*b* extends. The main part 3*a* of the article 3 comprises first and second regions R1, R2. The first region R1 is adjacent the upstream end UE of the main part 3*a* of the article. The second region R2 is adjacent the downstream end DE of the main part 3*a* of the article.

A susceptor S is located in the second region R2 of the main part 3*a* of the article 3, in this embodiment. However, in some embodiments, the susceptor S may be located on the second region R2 or both on and in the second region R2 of the main part 3*a* of the article 3. The susceptor S has the form of a coil and is formed from a magnetisable material, for example from iron or an alloy thereof. The susceptor S is arranged such that it aligns with the first induction coil 4*a* of the heater, when the article 3 is received within the heating chamber 5 (as shown in FIG. 3). The first region R1 of the main part 3*a* of the article 3 is free from a susceptor S, in this embodiment. The optional extension part 3*b* of the article 3 comprises a holder material within which a volatile flavour-generating component 3*c* in the form of a capsule 3*c* is retained. The capsule 3*c* contains a flavourant, which is methanol in this embodiment.

Figure 6:
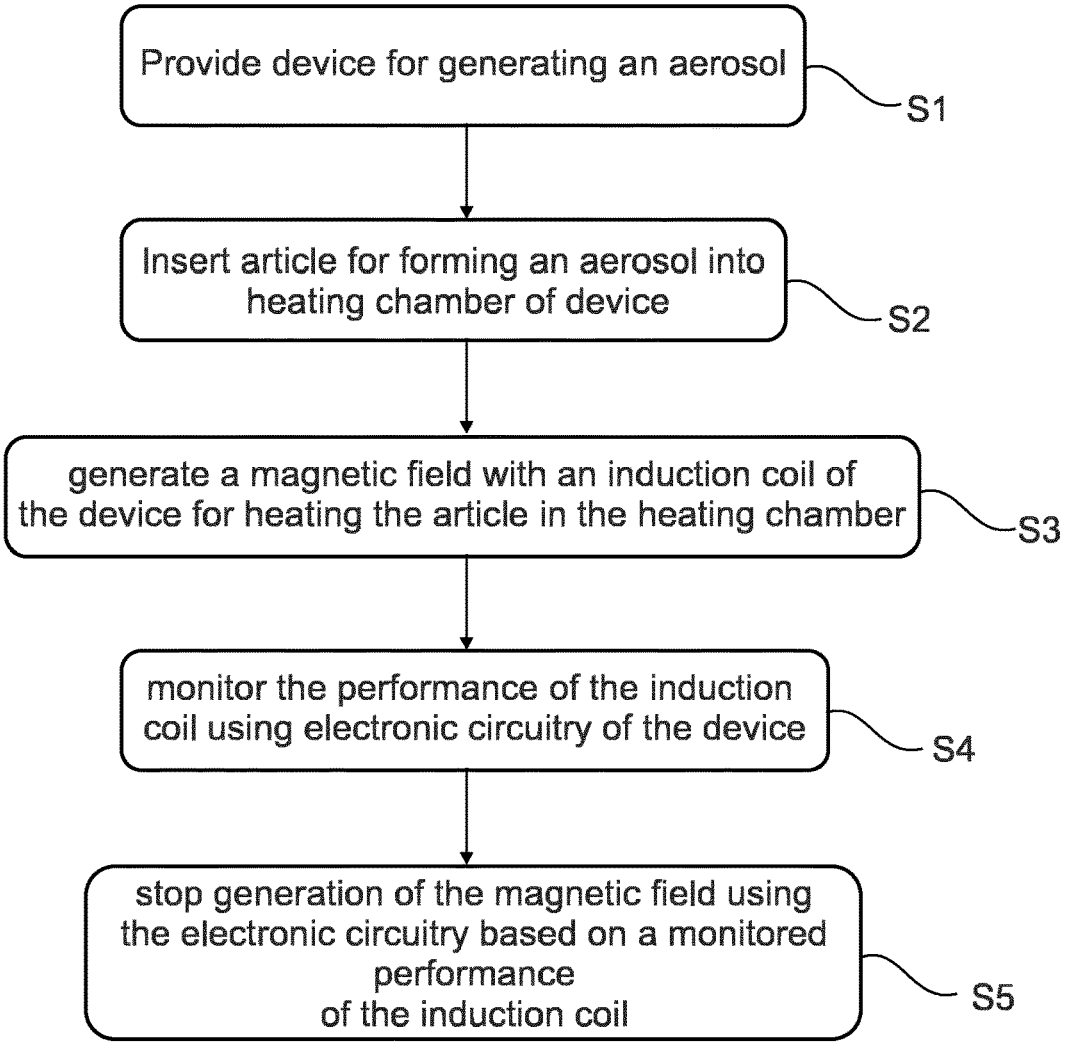
FIG. 6 is a flow diagram illustrating a method of using the device for generating an aerosol shown in FIG. 1.

Referring now to FIG. 6, there is shown a method of using the device 1. A device for generating an aerosol is provided to a user thereof, in a first step S1. The user of the device 1 then inserts an article 3 for forming an aerosol into the heating chamber 5 of the device 1, in a second step S2. In this embodiment, this insertion entails the user sliding the first portion 2*b* of the housing 2 relative to the second portion 2*c* of the housing 2 in the direction of arrow C, moving the heating chamber 5 into an open condition. An article 3 is then placed into the interior of the open device 1. The first portion 2*b* of the housing 2 is then slid relative to the second portion 2*c* of the housing 2 in the direction of arrow D (i.e. the opposite direction to that designated by arrow C), until the free end 2*e* of the extension portion 2*d* of the housing 2 is located above (relatively) the aerosol-forming substrate 3. The user then applies a perpendicular force against the extension portion 2*d* to resiliently press the tapered free end 2*e* of the extension portion 2*d* against the article 3. The user then continues to slide the first portion 2*b* of the housing 2 relative to the second portion 2*c* of the housing 2 in the direction of arrow C. The article 3 is thereby engaged by and moved therealong with and by the free end 2*e* of the extension portion 2*d*. In this way, the article 3 is moved into the heating chamber 5. The first portion 2*b* of the housing 2 is slid in the direction of arrow C until the free end 2*e* of the extension portion 2*d* engages against an abutment provided on the second portion 2*c* of the housing 2, which restricts further sliding in this direction. In this closed condition the first and second major boundary surfaces 5*a*, 5*b* of the heating chamber 5 are in parallel facing relations and the article 3 is located in the heating chamber 5 (as shown in FIGS. 2 and 3).

The article 3 is inserted into the heating chamber 5 of the device 1 such that the first region R1 of the main part 3*a* of the article 3 aligns with the first region R1 of the heating chamber 5 and the second region R2 of the main part 3*a* of the article 3 aligns with the second region R2 of the heating chamber 5. The optional extension part 3*b* of the article 3 extends beyond the heating chamber 5 and into the optional flavour-generation chamber 6. The capsule 3*c*, within the optional extension part 3*b*, is disposed in the optional flavour-generation chamber 6 and in alignment with the button 8 when the device 1 is in the closed condition.

In the closed condition the engagement member or catch 9*a* is aligned with the recess 9*b* and is resiliently biased into engagement thereinto. In this way, the abutment element 9 is coupled to the extension portion 2*d* of the first portion 2*b* of the housing 2 by the coupling mechanism.

The first and second induction coils 4*a*, 4*b* are then activated, in a third step S3, to generate magnetic fields in the first and second regions R1, R2 of the heating chamber 5 for heating the article 3 therein. This activation may be triggered by a trigger mechanism (not shown) such as a flow and/or pressure sensor which may be configured to respond to air flow and/or a change in air pressure resulting from a user drawing on the mouthpiece end 1*a* of the device 1. In some embodiments, however, the trigger mechanism may comprise a manually activated and/or activatable switch. The trigger mechanism (where provided) may be operatively connected to the electric circuitry E. Electrical energy from the power source is supplied to the first and second induction coils 4*a*, 4*b* under the control of the electric circuitry E (for example by activation of a switch). The flow of electrical energy through the first and second induction coils 4*a*, 4*b* generates magnetic fields in the first and second regions R1, R2 of the heating chamber 5.

In a fourth step S4, the performance of the induction coils 4*a*, 4*b* is monitored by the electric circuitry E. The current monitoring sensor measures the current flowing through each of the first and second coils 4*a*, 4*b* and transmits current data corresponding to the measured current to the processor.

The received current data is then compared with expected or desired (e.g. reference) current data. The magnetic field generated in the second region R2 of the heating chamber 5 by the second induction coil 4*b* induces heating of and by the susceptor S within the second region R2 of the main part 3*a* of the article 3 therewithin. The magnetic field generated in the first region R1 of the heating chamber 5 by the first induction coil 4*a* does not induce heating, due to the absence of a susceptor S in the first region R1 of the main part 3*a* of the article 3. The current flowing through the first coil 4*a* is therefore relatively low, whilst the current flowing through the second coil is relatively high. The current data is compared with expected or desired (e.g. reference) current data, which comprises a threshold amount of current in this embodiment. The current data for the first induction coil 4*a* is below the threshold amount of the expected or desired (e.g. reference) current data. The current data for the second induction coil 4*b* is above the threshold amount of the expected or desired (e.g. reference) current data.

In a fifth step S5, the processor of the electric circuitry E stops generation of the magnetic field in the first region R1 of the heating chamber 5 by the first induction coil 4*a* in response to the relatively low current measured in the current data. The second induction coil 4*b* continues to generate a magnetic field in the second region R2 of the heating chamber 5 by the second induction coil 4*b*.

As will be appreciated, if the article 3 is inserted incorrectly into the heating chamber 5, for example such that the first and second regions R1, R2 of the main part 3*a* of the article 3 are not aligned with the first and second regions R1, R2, respectively, of the heating chamber 5 the measured current in the induction coils 4*a*, 4*b* may be different. Where the first and second regions R1, R2 of the article 3 are misaligned with the first and second regions R1, R2 of the heating chamber the current monitoring sensor may measure currents through each induction coil 4*a*, 4*b* which are lower than the threshold amount of the expected or desired (e.g. reference) current data. Under this arrangement, the processor may therefore be operable to stop a magnetic field being generated in both induction coils 4*a*, 4*b*. Additionally, if a different article for forming a substrate having a different configuration is inserted into the heating chamber 5 (for example absent a susceptor S or having a susceptor in a different location) the processor may also stop generation of magnetic fields by one or both of the induction coils 4*a*, 4*b*.

Air is drawn through the device 1, in this embodiment, by the user drawing on the mouthpiece end 1*a* of the device 1. The air flows from the removal aperture 2*f*, through the inlet 5*c* of the heating chamber 5, along the principal flow axis P (i.e. parallel thereto) of the heating chamber, and exits the heating chamber 5 through the outlet 5*d*. The air passes through the main part 3*a* of the article 3 from its upstream end UE to its downstream end DE, whereby volatilized compounds are entrained into the flow of air through the heating chamber 5. When the air flow and volatilized compounds mixture reaches the cooling chamber 7 the mixture expands due to the relatively increased cross-sectional area of the cooling chamber 7. The mixture thereby cools in the cooling chamber 7 and the volatilized compounds coalesce into and form an aerosol. The aerosol is then drawn through the mouthpiece 2*a* and to the user drawing thereupon.

The user can depress the button 8 into the optional flavour-generation chamber 6 to crush the adjacent capsule 3*c* within the optional extension part 3*b* of the article 3, thereby releasing flavourants therefrom. Flavourants released from the capsule 3*c* will then be drawn to the user through an air flow through the device 1 caused by a user drawing on the mouthpiece end 1*a* of the device 1.

After use of the article 3 it can be removed from the device 1. The user slides the first portion 2*b* of the housing 2 relative to the second portion 2*c* of the housing 2 in the direction of arrow D, moving the device 1 away from the closed condition and toward the open condition. The abutment element 9 (which is coupled to the extension portion 2*d* of the first portion 2*b* of the housing 2 by the coupling mechanism) is dragged by the first portion 2*b* of the housing 2 to contact and push the article 3 out of the optional flavour-generation chamber 6 and the heating chamber 5. Continued sliding of the first portion 2*b* of the housing (relative to the second portion 2*c* of the housing 2) in the direction of arrow D causes the abutment element 9 to push the used article 3 into the removal aperture 2*f*. The guide surfaces of the removal aperture 2*f* guide the article 3 to slide out of the device 1, from where it may be collected by any suitable means.

The article 3 is removed from the device 1 when its supply of volatilizable compounds has been exhausted, when a set number of draws has been applied to the device 1, or when the user decides to change the article 3 for any other reason (for example to experience a different flavour).

While the device 1 is described as comprising first and second induction coils 4*a*, 4*b* this need not be the case and, instead, the device 1 may comprise only one induction coil or may comprise more than two induction coils. Additionally or alternatively, the or each induction coil may be located in any suitable location relative to the heating chamber 5, for example a first coil 4*a* may be located adjacent the first major boundary surface 5*a* and a second coil 4*b* may be located adjacent the second major boundary surface 5*b*. Additionally or alternatively, the, some or each induction coil may be arranged to generate a magnetic field across a minor, a major or substantially all of the heating chamber 5.

While the electric circuitry E of the device is described as monitoring the performance of the induction coils 4*a*, 4*b* by measuring the current flowing therethrough this need not be the case and, additionally or alternatively the performance of the induction coils 4*a*, 4*b* may be monitored indirectly by measuring the temperature of the heating chamber 5 (e.g. of the first and/or second regions R1, R2 thereof) and/or of the article 3 received therein (or a portion thereof) using the temperature sensor E1. In some embodiments, the processor may be operable to selectively stop one or both induction coils 4*a*, 4*b* responsive to the measured temperature in comparison with expected or desired (e.g. reference) temperature data, additionally or alternatively.

Additionally or alternatively, the current data generated by the current monitoring sensor may correspond to one or more characteristic of the article 3 for forming a substrate. For example, the current data may comprise operation information relating to one or more of: operating temperature parameters of the article; desired duration of heating of the article; desired total thermal energy transfer to the article; number of heating cycles to which the article may be subjected; and the type and/or condition of the article within the heating chamber 5. In some embodiments, the device 1 may comprise a display, for example a screen which may be configured to display one or more images relating to articles for forming an aerosol. When a particular type of article is detected, by monitoring of the performance of the induction coils 4*a*, 4*b*, an image corresponding to that detected article may be displayed on the screen of the device.

While the generation of a magnetic field is described as being stopped in the embodiment shown in FIG. 6, alternatively the generation of a magnetic field may be controlled (e.g. altered) instead, for example the electrical energy supplied to one or both of the induction coils 4*a*, 4*b* may be increased or decreased and/or the frequency of the magnetic field may be controlled (e.g. increased or decreased). While the electric circuitry E is described as stopping the generation of the magnetic field by the first induction coil 4*a* and allowing continued generation of a magnetic field by the second induction coil 4*b* this need not be the case and, instead generation of a magnetic field by the second coil 4*b* may be stopped also, for example if the susceptor S in the second region R2 of the main part 3*a* of the article 3 is of a size, shape, location and/or configuration which produces a current flow through the second coil 4*b* less than the threshold value of the expected or desired (e.g. reference) current. In some embodiments, the susceptor S may move within the heating chamber 5 during heating of the article 3, for example due to expansion and/or contraction of the article 3. Where the susceptor S moves within the heating chamber 5 the current measured as flowing through the first and/or second induction coils 4*a*, 4*b* may change. This change in current may cause the electric circuitry E to stop generation of a magnetic field by one or both of the induction coils 4*a*, 4*b*.

In some embodiments, the electric circuitry E may comprise a memory within which one or more of the following may be stored: the measured current data; the measured temperature data; data corresponding to the number of activations of the device 1; data corresponding to the number of times a coil has been stopped from generating a magnetic field; data corresponding to the movement of a susceptor S within the heating chamber 5 (where this occurs); and the like. Additionally or alternatively, the above-described data may be transmitted from the device 1, e.g. from the electric connection EC and/or via wireless transmission.

Whilst the first portion 2*b* of the housing 2 is described as being slidable relative to the second portion 2*c* of the housing 2 this need not be the case and, instead, the first portion 2*b* may be pivotable relative to the second portion 2*c* and/or removable therefrom. In some embodiments, the first portion 2*b* may be fixed relative to the second portion 2*c* of the housing 2 (such that the first and second major boundary surfaces 5*a*, 5*b* of the heating chamber 5 are also fixed relative to one another). Where the first and second portions 2*a*, 2*b* are fixed relative to one another the device 1 may comprise a carriage for holding and/or guiding an aerosol-forming substrate into and/or out of the heating chamber 5. The device may be configured to support the carriage in sliding relation thereto.

In some embodiments, the device 1 may comprise plural heaters (that is, a plurality of heaters), which may comprise both a heater configured or arranged to heat the first and/or second major boundary surfaces 5*a*, 5*b* (for example of the type of heater 4 shown in FIG. 4) and a heater configured to heat the susceptor of an article 3 received in the heating chamber 5 (for example of the type of heater 14 shown in FIG. 5). Alternatively, the device 1 may comprise plural heaters comprising a first heater arranged to heat the first major boundary surface 5*a* and a second heater arranged to heat the second major boundary surface 5*b*. In some embodiments, the device 1 may comprise plural heaters, one heater being arranged to heat at least a portion of the surface of an article 3 received between the first and second major boundary surfaces 5*a*, 5*b*, and a second heater being arranged to heat an internal region of the article 3. Where there are plural heaters they may be configured to heat at different times and/or to different temperatures. In some embodiments, where the device 1 comprises a single heater 4 or plural heaters, it or they may be arranged or configured to heat only one of the first and second major boundary surfaces 5*a*, 5*b*.

In some embodiments, the device 1 may comprise a susceptor altering means or mechanism for altering the operation of a susceptor S of an article 3 for forming an aerosol received within the heating chamber 5. The susceptor altering means or mechanism may comprise a hook, in some embodiments. The hook may be operatively moved to engage the article 3 after heating thereof in the heating chamber 5. The hook may be movable to alter the condition of the susceptor, for example to break and/or deform the susceptor S after heating of the article 3 in the heating chamber 5. Movement of the hook to break or deform the susceptor may be operatively controlled by the electric circuitry E or may be manually operated by a user of the device 1. In some embodiments, the hook may be moved to engage an article 3, e.g. a susceptor S of an article 3. Alteration of the susceptor may comprise removing the article 3 from the heating chamber 5 of the device 1, for example removal of the article 3 from the heating chamber 5 may cause or allow the hook (or other susceptor altering means) to alter the susceptor S of the article 3. In this way, the article 3 for forming an aerosol may be altered when it has been used in the heating chamber 5 and/or the article 3 may be prevented from being used again (e.g. heated again) in the heating chamber 5 of the or a device 1 for generating an aerosol.

Additionally or alternatively, although the heating chamber 5 and the article 3 are shown as having a generally parallelepiped shape, this need not be the case and instead the heating chamber 5 and/or the article 3 may have any suitable shape.

The schematic drawings are not necessarily to scale and are presented for purposes of illustration and not limitation. The drawings depict one or more aspects described in this disclosure. However, it will be understood that other aspects not depicted in the drawings fall within the scope of this disclosure.

The invention claimed is:

1. A device for generating an aerosol, comprising:

a heating chamber comprising first and second regions and being configured to receive an article for forming an aerosol, the first region being adjacent or spaced from the second region;

a first induction coil configured to generate a magnetic field to heat the article received in the heating chamber, the first induction coil being arranged to selectively generate the magnetic field, in use, to beat or to induce heating of the heating chamber;

a second induction coil configured to generate a magnetic field in the second region of the heating chamber; and electric circuitry configured to monitor performance of one or both of the first induction coil and the second induction coil, and alter a shape or a size or a condition of a susceptor of the article for forming the aerosol received in the heating chamber by overheating the susceptor of the article to prevent the susceptor of the article from being reused.

2. The device according to claim 1, wherein the electric circuitry is further configured to control the one or both of the first induction coil and the second induction coil to generate the magnetic field based on the monitored performance of the one or both of the first and the second induction coils.

3. The device according to claim 1, wherein the electric circuitry is further configured to monitor a current flowing through the one or both of the first and the second induction coils.

4. The device according to claim 3, wherein the electric circuitry comprises a current sensor configured to measure the current flowing through the one or both of the first and the second induction coils.

5. The device according to claim 3, wherein the electric circuitry is further configured to control the one or both of the first and the second induction coils to generate the magnetic field when a monitored current flowing through the one or both of the first and the second induction coils differs from an expected current.

6. The device according to claim 5, wherein the electric circuitry is further configured to control the one or both of the first and the second induction coils to generate the magnetic field when the monitored current flowing through the one or both of the first and the second induction coils differs from the expected current for a duration equal to or greater than a predetermined time period.

7. The device according to claim 1, wherein the electric circuitry is further configured to monitor a temperature of at least one of the heating chamber and the article received in the heating chamber.

8. The device according to claim 7, wherein the electric circuitry comprises a temperature sensor configured to measure the temperature of the at least one of the heating chamber and the article received in the heating chamber.

9. The device according to claim 7, wherein the electric circuitry is further configured to control the one or both of the first and the second induction coils to generate the magnetic field when the monitored temperature of the at least one of the heating chamber and the article received in the heating chamber differs from an expected temperature.

10. The device according to claim 9, wherein the electric circuitry is further configured to control the one or both of the first and the second induction coils to generate the magnetic field when the monitored temperature of the at least one of the heating chamber and the article received in the heating chamber differs from the expected temperature for a duration equal to or greater than a predetermined time period.

11. The device according to claim 2, wherein the electric circuitry is further configured to prevent reactivation of the one or both of the first and the second induction coils, after generation of the magnetic field by the one or both of the first and the second induction coils has been stopped, unless or until a replacement article configured to form an aerosol is received in the heating chamber.

12. The device according to claim 1, wherein the magnetic field is a varying magnetic field.

13. A method of generating an aerosol, the method comprising:

a) providing a device configured to generate the aerosol, the device comprising a heating chamber configured to receive an article for forming the aerosol, a first induction coil, and electric circuitry, the heating chamber comprising first and second regions, the first region being adjacent or spaced from the second region;

b) generating a magnetic field with the first induction coil to heat the heating chamber and/or the article received therein;

c) providing a second induction coil arranged to generate a magnetic field in the second region of the heating chamber;

d) monitoring performance of one or both of the first induction coil and the second induction coil using the electric circuitry; and e) providing a susceptor altering means or mechanism to alter operation of a susceptor of the article for forming the aerosol received in the heating chamber to prevent the susceptor of the article from being reused.

14. The method according to claim 13, further comprising: f) controlling generation of the magnetic field by the one or both of the first and the second induction coils using the electric circuitry, based on the monitored performance of the one or both of the first and the second induction coils.

15. The method according to claim 13, wherein the magnetic field is a varying magnetic field.

16. A device for generating an aerosol, comprising:

a heating chamber comprising first and second regions and being configured to receive an article for forming an aerosol, the first region being adjacent or spaced from the second region;

a first induction coil configured to generate a magnetic field to heat the article received in the heating chamber, the first induction coil being arranged to selectively generate the magnetic field, in use, to heat or to induce heating of the heating chamber;

a second induction coil configured to generate a magnetic field in the second region of the heating chamber;

electric circuitry configured to monitor performance of one or both of the first induction coil and the second induction coil; and a mechanical susceptor altering mechanism configured to deform and/or to break the susceptor of the article to prevent the susceptor of the article from being reused.

* * * * *